US009765584B2

(12) United States Patent
Lorenson et al.

(10) Patent No.: US 9,765,584 B2
(45) Date of Patent: Sep. 19, 2017

(54) FLOW CONTROLLING DOWNHOLE TOOL

(71) Applicant: TLL Oilfield Consulting Ltd., Edmonton (CA)

(72) Inventors: Troy Lorenson, Edmonton (CA); David Nicholson, Edmonton (CA); Petr Macek, Sherwood Park (CA)

(73) Assignee: TLL Oilfield Consulting Ltd., Edmonton (CA)

( * ) Notice: Subject to any disclaimer, the term of this patent is extended or adjusted under 35 U.S.C. 154(b) by 0 days.

(21) Appl. No.: 14/771,418

(22) PCT Filed: Dec. 2, 2014

(86) PCT No.: PCT/CA2014/051155

§ 371 (c)(1),
(2) Date: Aug. 28, 2015

(87) PCT Pub. No.: WO2015/081432

PCT Pub. Date: Jun. 11, 2015

(65) Prior Publication Data

US 2016/0281449 A1 Sep. 29, 2016

Related U.S. Application Data

(60) Provisional application No. 61/911,286, filed on Dec. 3, 2013.

(51) Int. Cl.
*E21B 21/08* (2006.01)
*E21B 21/10* (2006.01)
(Continued)

(52) U.S. Cl.
CPC ..... *E21B 21/103* (2013.01); *E21B 4/02* (2013.01); *E21B 6/02* (2013.01); *E21B 7/24* (2013.01); *E21B 21/08* (2013.01); *E21B 21/10* (2013.01)

(58) Field of Classification Search
CPC ... E21B 4/02; E21B 7/24; E21B 21/10; E21B 4/14; E21B 7/18; E21B 6/02
See application file for complete search history.

(56) References Cited

U.S. PATENT DOCUMENTS 2,250,912 A 7/1941 Hudson et al.
2,329,912 A 9/1943 Kent et al.
(Continued)

FOREIGN PATENT DOCUMENTS

CA 2 255 065 C 1/2007
CA 2 312 341 C 8/2007
(Continued)

OTHER PUBLICATIONS

International Search Report dated Feb. 23, 2015 issued in counterpart application No. PCT/CA2014/051155 (3 pages).
(Continued)

*Primary Examiner* — Daniel P Stephenson
(74) *Attorney, Agent, or Firm* — Westerman, Hattori, Daniels & Adrian, LLP

(57) ABSTRACT

A downhole tool assembly for use in a drilling string includes a motor, a flow head, and a flow restrictor. The flow head is coupled to the motor and comprises a plurality of ports permitting fluid communication therethrough. The flow restrictor is in fluid communication with the flow head and comprises a plurality of ports permitting fluid communication therethrough. The flow restrictor is stationary with respect to the flow head, which rotates. As the flow head rotates, one or more of the plurality of ports of the flow head enters into and out of alignment with one or more of the plurality of ports of the flow restrictor such that fluid flow through the ports of the flow head and the flow restrictor is constrained to a cyclic, polyrhythmic pattern optionally
(Continued)

including at least one interval where the fluid flow is substantially blocked by the flow restrictor.

39 Claims, 10 Drawing Sheets

(51) Int. Cl.

| | |
|---|---|
| ***E21B 4/02*** | (2006.01) |
| ***E21B 6/02*** | (2006.01) |
| ***E21B 7/24*** | (2006.01) |

(56) References Cited

U.S. PATENT DOCUMENTS

| | | | | |
|---|---|---|---|---|
| 2,738,956 | A | 3/1956 | Bielstein | |
| 2,743,083 | A | 4/1956 | Zublin | |
| 2,746,721 | A | 5/1956 | Moore | |
| 2,780,438 | A | 2/1957 | Bielstein | |
| 2,896,916 | A | 7/1959 | Clavier et al. | |
| 2,942,851 | A | 6/1960 | Beck | |
| 3,096,833 | A | 7/1963 | Bodine | |
| 3,216,514 | A | 11/1965 | Nelson | |
| 3,270,822 | A | 9/1966 | Cleary | |
| 3,640,351 | A | 2/1972 | Coyne et al. | |
| 3,894,818 | A | 7/1975 | Tschirky | |
| 3,899,033 | A | 8/1975 | Van Huisen | |
| 3,933,209 | A | 1/1976 | Sweeney | |
| 3,941,196 | A | 3/1976 | Curington et al. | |
| 4,080,115 | A | 3/1978 | Sims et al. | |
| 4,384,625 | A | 5/1983 | Roper et al. | |
| 4,817,739 | A | 4/1989 | Jeter | |
| 4,819,745 | A | 4/1989 | Walter | |
| 4,830,122 | A | 5/1989 | Walter | |
| 4,890,682 | A | 1/1990 | Worrall et al. | |
| 4,953,595 | A | 9/1990 | Kotlyar | |
| 4,979,577 | A | 12/1990 | Walter | |
| 5,009,272 | A | 4/1991 | Walter | |
| 5,048,622 | A | 9/1991 | Ide | |
| 5,139,400 | A | 8/1992 | Ide | |
| 5,190,114 | A | 3/1993 | Walter | |
| 5,662,180 | A | 9/1997 | Coffman et al. | |
| 6,279,670 | B1 * | 8/2001 | Eddison | E21B 4/02 175/107 |
| 9,004,194 | B2 * | 4/2015 | Eddison | E21B 7/24 175/107 |
| 9,091,123 | B2 * | 7/2015 | Gust | E21B 7/24 |
| 9,371,692 | B2 * | 6/2016 | Eddison | E21B 4/14 |
| 2013/0277116 | A1 * | 10/2013 | Knull | E21B 4/003 175/57 |
| 2014/0041943 | A1 * | 2/2014 | Lanning | E21B 4/02 175/57 |
| 2014/0190749 | A1 * | 7/2014 | Lorenson | E21B 21/10 175/51 |
| 2014/0246240 | A1 * | 9/2014 | Lorenson | E21B 4/02 175/57 |

FOREIGN PATENT DOCUMENTS

| | | | | |
|---|---|---|---|---|
| CA | 2 680 895 | A1 | 3/2011 | |
| CA | 2 487 380 | C | 2/2013 | |
| CA | WO 2015081432 | A1 * | 6/2015 | E21B 4/02 |
| EP | 0 335 543 | A1 | 10/1989 | |
| GB | 2 059 481 | A | 4/1981 | |
| GB | WO 2011058307 | A2 * | 5/2011 | E21B 4/18 |
| WO | 94/16189 | A1 | 7/1994 | |
| WO | 2012/138383 | A2 | 10/2012 | |

OTHER PUBLICATIONS

Examination Report dated Apr. 23, 2015 issued in counterpart application No. CA2,872,736 (3 pages).

Drill On Target Directional Services Inc., "Drill On Target: Advanced Drilling Solutions", published at least as early as Aug. 20, 2015 (5 pages).

Wedel, Ryan et al., "Mitigating Bit-Related Stick-Slip With A Torsional Impact Hammer", 2011 AADE National Technical Conference and Exhibition held at the Hilton Houston North Hotel, Houston, Texas, Apr. 12-14, 2011 (5 pages).

Powell, Scott et al., "Fluid Hammer Increases PDC Performance through Axial and Torsional Energy at the Bit", SPE 166433, SPE Annual Technical Conference and Exhibition, New Orleans, Louisiana, USA, Sep. 30-Oct. 2, 2013, pp. 1-7.

* cited by examiner

FLOW CONTROLLING DOWNHOLE TOOL

CROSS-REFERENCE TO RELATED APPLICATIONS

This application claims priority to U.S. Provisional Application No. 61/911,286 filed Dec. 3, 2013, the entirety of which is incorporated herein by reference.

TECHNICAL FIELD

The present disclosure relates to downhole drilling assemblies for use in oil and gas production and exploration.

TECHNICAL BACKGROUND

In oil and gas production and exploration, downhole drilling can be accomplished with a downhole drill through which drilling fluid, conventionally referred to as drilling mud, is pumped. The drilling fluid assists in the drilling process in a number of ways, for example by dislodging and removing drill cuttings, cooling the drill bit, and providing pressure to prevent formation fluids from entering the wellbore.

It has been found that applying a vibrational and/or percussive effect, which can be accomplished through regulation of the drilling fluid flow, can improve the performance of the downhole drill. Examples of downhole drill assemblies providing such an effect are described in Canadian Patent Application No. 2,798,807, having common inventors with the present application, and Canadian Patent No. 2,255,065. In some cases, a vibrational or percussive effect can adversely affect measurement while drilling (MWD) or survey equipment mounted in the drilling string.

BRIEF DESCRIPTION OF THE DRAWINGS

In drawings which illustrate by way of example only embodiments of the present disclosure, in which like reference numerals describe similar items throughout the various figures.

DETAILED DESCRIPTION OF THE INVENTION

Figure 1:
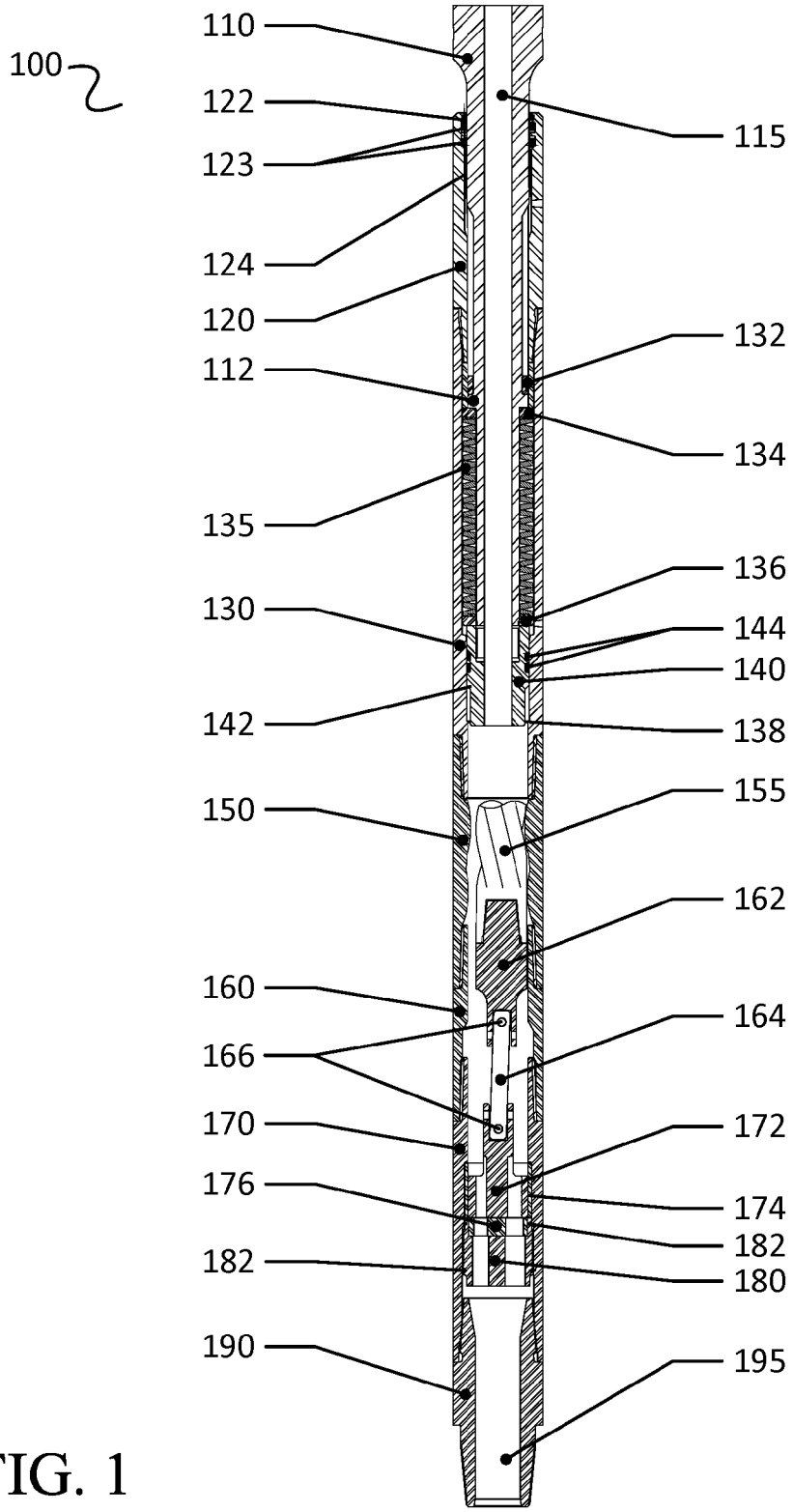
FIG. 1 depicts a cross-section of an embodiment of a downhole tool assembly.

The present embodiments and examples provide a flow controlling downhole tool for controlling the flow of drilling fluid in a downhole drill string, and components thereof, directed to an improvement in downhole drilling operations utilizing a vibrational effect.

In the present embodiments and examples, there is provided a downhole tool assembly, comprising: a motor; a flow head comprising a plurality of ports permitting fluid communication therethrough and arranged around a central axis of the flow head, the flow head being coupled to a rotor of the motor to be driven thereby in rotational motion around the central axis; a flow restrictor in fluid communication with the flow head, the flow restrictor comprising a plurality of ports permitting fluid communication therethrough, the flow restrictor being stationary with respect to the rotational motion of the flow head, wherein rotation of the flow head with respect to the flow restrictor causes one or more of the plurality of ports of the flow head to enter into and out of alignment with one or more of the plurality of ports of the flow restrictor such that fluid pressure resulting from fluid flow through the ports of the flow head and the flow restrictor is constrained to a cyclic, polyrhythmic pattern.

In one aspect, the pattern comprises a plurality of fluid pressure peaks of varying amplitude within a single revolution of the flow head in the downhole tool assembly, and/or a plurality of time intervals of different durations between adjacent fluid pressure peaks within a single revolution of the flow head in the downhole tool assembly, and/or at least one interval where the fluid flow is substantially blocked by the flow restrictor.

In another aspect, the flow head comprises a plurality of ports having at least two different cross-sectional areas, and the flow restrictor comprises a plurality of ports having at least two different cross-sectional areas.

In a further aspect, the at least two different cross-sectional areas of the plurality of ports of the flow head are different than the at least two different cross-sectional areas of the plurality of ports of the flow restrictor. Still further, the flow head can have a different number of ports than the flow restrictor.

In one aspect, at least one port of the plurality of ports of the flow head comprises an elongated port.

In still another aspect, the motor comprises a positive displacement motor having a stator with a different number of lobes than the rotor.

In yet a further aspect, the downhole tool assembly further comprises a bearing constraining motion of the flow head to rotational motion around the central axis. In another aspect, the assembly also includes an inverter sub in fluid communication with the motor, the motor being positioned between the inverter sub and the flow head, the inverter sub imparting an axial movement to a mandrel.

In still a further aspect, the flow restrictor comprises a wear insert between the flow head and the flow restrictor, the wear insert comprising ports permitting fluid communication between the flow head and ports of the flow restrictor.

There is also provided a valve component for use in a downhole drilling string, the valve component comprising: a flow head comprising a plurality of ports permitting fluid communication therethrough and arranged around a central axis of the flow head, the plurality of ports including ports of different sizes; a flow restrictor comprising a plurality of ports permitting fluid communication therethrough, the plurality of ports including ports of different sizes; the arrangement of the plurality of ports of the flow head being arranged such that rotation of the flow head around its central axis with respect to the flow restrictor causes one or more of the plurality of ports of the flow head to enter into and out of alignment with one or more of the plurality of ports of the flow restrictor, such that fluid pressure resulting from fluid flow through the ports of the flow head and the flow restrictor is constrained to a cyclic, polyrhythmic pattern.

In one aspect, the pattern comprises a plurality of fluid pressure peaks of varying amplitude within a single revolution of the flow head in the valve component, and/or a plurality of time intervals of different durations between adjacent fluid pressure peaks within a single revolution of the flow head in the valve component, and/or at least one interval where the fluid flow is substantially blocked by the flow restrictor.

In another aspect, the sizes of the ports of the flow restrictor are different from the sizes of the ports of the flow head, and/or the flow head has a different number of ports than the flow restrictor, and/or at least one port of the plurality of ports of the flow head comprises an elongated port.

In a further aspect, the plurality of ports of the flow restrictor are arranged around a central axis of the flow restrictor, and the plurality of ports around at least one of the flow restrictor and the flow head are irregularly spaced around the respective central axis.

In still another aspect, the flow head further comprises a mounting end for coupling to a drive shaft of a motor.

Still further, in an aspect the flow restrictor comprises a wear insert between the flow head and the flow restrictor, the wear insert comprising ports permitting fluid communication between the flow head and ports of the flow restrictor.

There is also provided a drilling string including the aforementioned valve component or downhole tool assembly.

There is also provided a method of varying drilling fluid pressure in a downhole drilling string, the method comprising varying flow of the drilling fluid in the drilling string above a drilling tool of the drilling string such that the pressure of the drilling fluid varies in a cyclic, polyrhythmic pattern.

In one aspect, the pattern comprises at least one interval in its cycle where the flow of the drilling fluid is substantially stopped, and/or a plurality of fluid pressure peaks of varying amplitude, and/or a plurality of time intervals of different durations between adjacent fluid pressure peaks.

In another aspect, the pattern is defined by interference between a flow head rotating in the drilling string relative to a flow restrictor positioned in the drilling string, each of the flow head and the flow restrictor comprising a plurality of ports, the plurality of ports in the flow head comprising different sizes and the plurality of ports in the flow restrictor comprising different sizes, wherein the flow of the drilling fluid is determined by alignment of any of the plurality of ports of the flow head with any of the plurality of ports of the flow restrictor.

In a further aspect, the flow head comprises a number of ports of at least two different sizes and the flow restrictor comprises a different number of ports of at least two different sizes, the at least two different sizes of the flow restrictor ports being different than the sizes of the flow head ports.

In yet another aspect, the method further comprises rotating the flow head using a positive displacement motor, the flow head being constrained to rotational motion around a central axis of the flow head within the drilling string.

In still another aspect, the flow of the drilling fluid is substantially stopped when all of the plurality of ports of the flow head are blocked by the flow restrictor.

In yet a further aspect, a variation in flow of the drilling fluid induces a corresponding variation in pressure in the drilling string by means of an inverter sub comprised in the drilling string.

Figure 2:
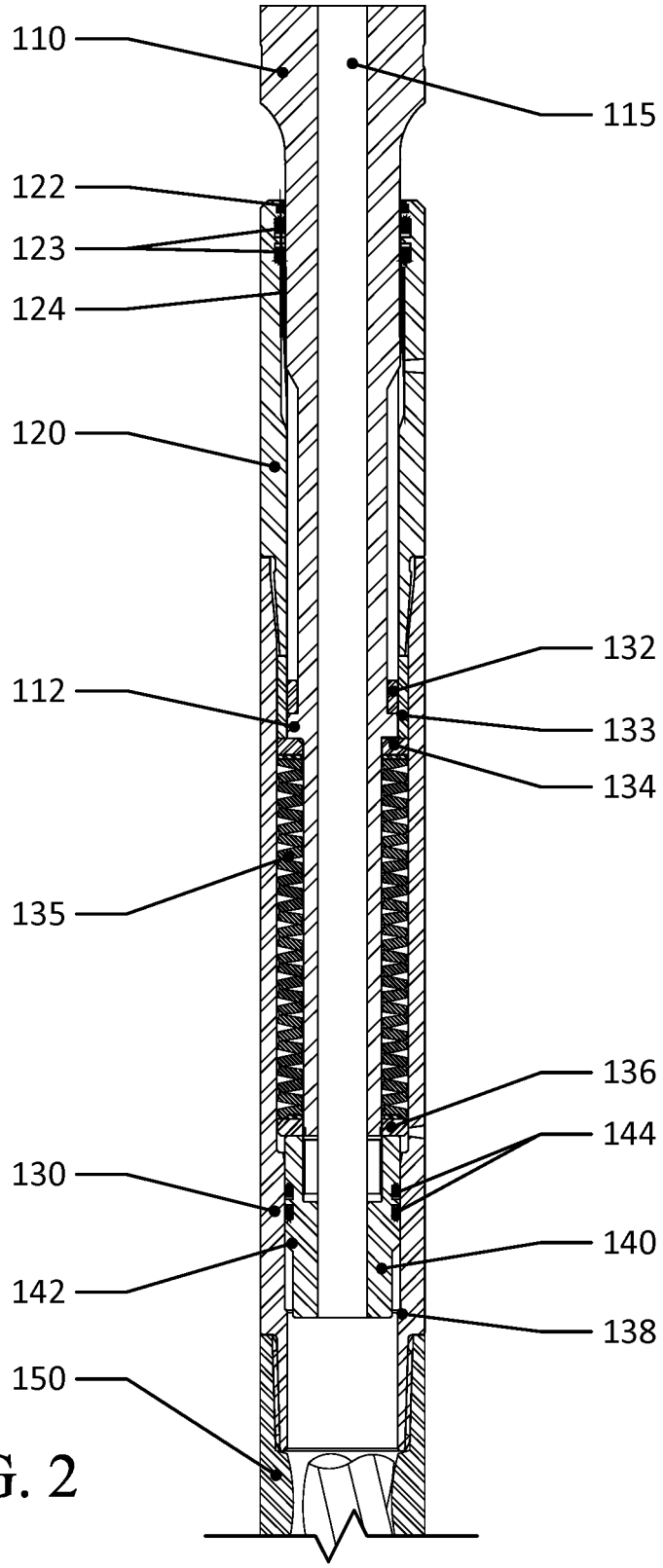
FIGS. 2 and 3 are enlarged views of portions of the cross-section of FIG. 1.
Figure 3:
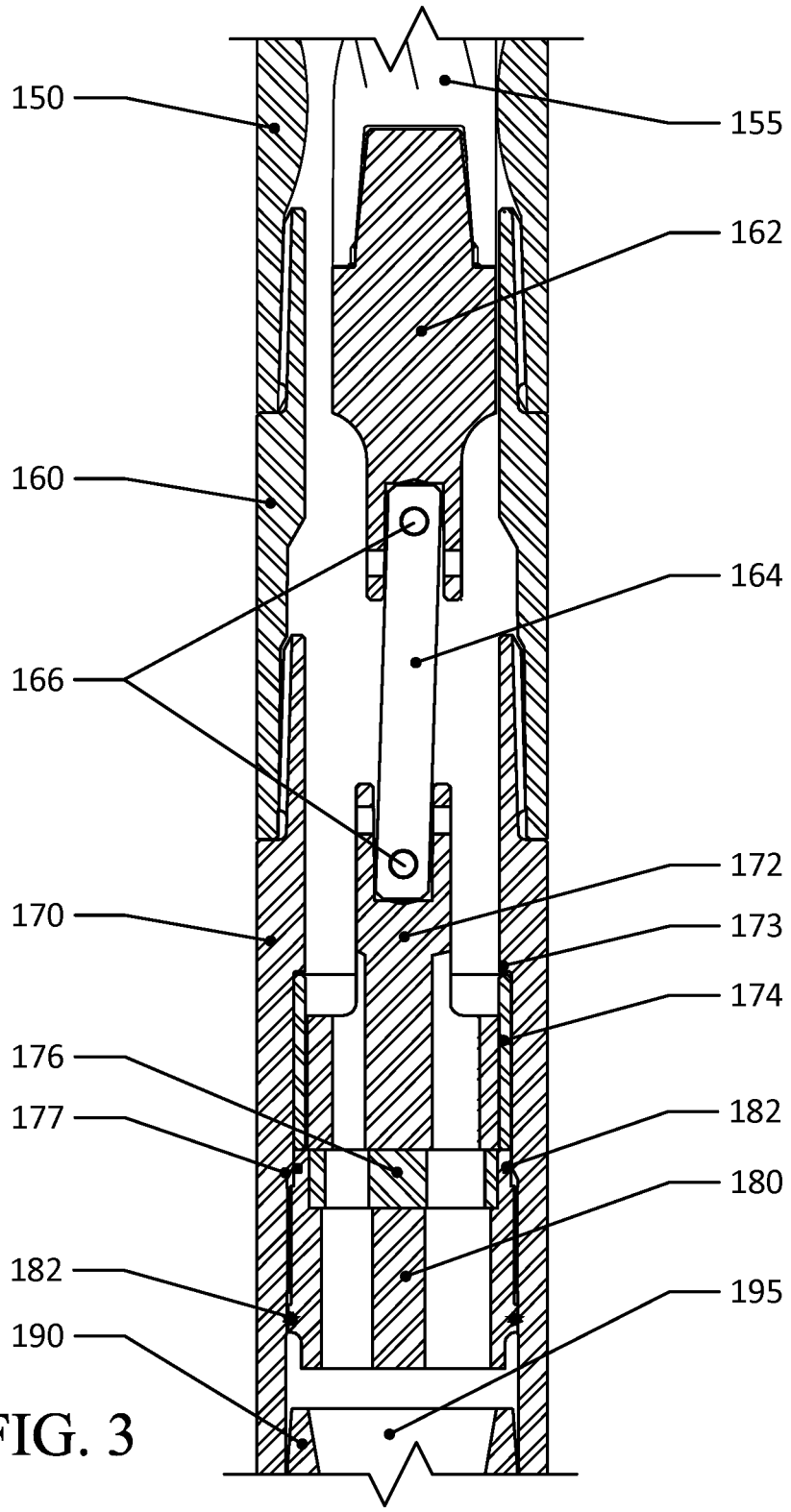

FIGS. 1-3 illustrate a lateral cross-sectional view of an embodiment of the downhole tool assembly 100, where FIGS. 2 and 3 provide enlarged views of sections of the cross-sectional view of FIG. 1. The downhole tool assembly 100 forms part of a drill string for use in downhole drilling applications. The entirety of the drill string is not shown in the accompanying drawings. In this example, the downhole tool assembly 100 is mounted on the drill string by a mandrel 110 that can be coupled to other components of the drill string. The mandrel 110 is splined to an inverter system, here referred to as an inverter sub, by means of a spline housing 120. Sealing contact between the spline housing 120 and the mandrel 110 is provided in this example with a wiper 122 and wiper seals 123. A bushing 124 provides a bearing surface for the mandrel 110 in the spline housing 120.

The mandrel 110 extends into a housing 130 of the inverter sub. The positioning of the mandrel 110 within the inverter sub is assisted by a split ring 132 within a sleeve 133, the sleeve 133 being mounted on an interior face of the inverter sub housing 130. The split ring 132-sleeve 133 assembly limits potential travel of the mandrel within the housing 130. The mandrel 110 is sized so that a lower end of the mandrel 110 can be received within the inverter sub 130. The inverter sub 130 is provided with a shock absorbing and releasing assembly 135, in this example a mechanical spring assembly disposed in an annular space within the inverter sub housing 130, which stores and releases kinetic energy resulting from the pressure build-ups resulting from rotation of the flow head 172 discussed below. An exterior shoulder 112 of the mandrel 110, which is larger in diameter than the lower portion of the mandrel 110 but smaller than an interior diameter of the inverter sub, sits on an interior shoulder 134 of the inverter sub, above the assembly 135. The interior shoulder 134 may be provided with a spacer and/or shim that assists in positioning the mandrel in relation to the assembly 135.

The mandrel 110 terminates with a piston nut 140 spaced from the assembly 135 by a second spacer 136. The piston nut 140 is sized to travel axially within the interior diameter of the inverter sub housing 130. As can be seen most clearly in FIG. 2, the interior of the inverter sub housing 130 is provided with a shoulder 138 below the assembly 135, and the interior diameter of the inverter sub housing 130 is thus reduced below the shoulder 138. The piston nut 140 is sized so that its lower exterior diameter fits within the lower smaller diameter of the inverter sub housing 130. The exterior diameter of the piston nut 140 enlarges at a shoulder 142, above which the exterior diameter is greater than the lower exterior diameter. The exterior diameter of the piston nut 140 above the shoulder 142 can be approximately the same as the diameter of the mandrel 110 around the level of the bushing 124.

As can be seen most easily from the drawings, and as understood in the art, the mandrel 110, spline housing 120, inverter sub 130, and piston nut 140 permit fluid communication via an axial flow-through passage or bore 115 between the other components of the drill string above the mandrel 110 and a motor section of the downhole tool assembly 100, discussed below. In operation, drilling fluid flows through the passage 115. Sealing engagement between the piston nut 140 and the inverter sub 130 housing may be provided, for example with sealing rings 144, to isolate the assembly 135 from drilling fluid passing through the passage 115.

It will be appreciated by those skilled in the art that the attachment of the downhole tool assembly, and specifically the motor section, flow head, and flow restrictor described below, to the drill string (e.g. via the spline housing 120), can be accomplished by any suitable means and components that are known in the art. The invention contemplated herein is not intended to be limited to the specific examples set out in this description. For example, where appropriate, specific components may be arranged in a different order than set out in these examples, or even omitted or substituted. Coupling of the various components described herein can be accomplished using any appropriate coupling means known in the art.

Also in fluid communication via the passage 115 with the other components of the drilling string is a motor section. The motor section in this example is a positive displacement motor or pump comprising a multi-lobe rotor 155 rotating in a multi-lobe stator 150. In this example, the multi-lobe stator 150 comprises its own housing and is coupled to the inverter sub housing 130, for instance by a threaded connection. Of course, it will be understood by those skilled in the art that other stator configurations, including those with a separate housing, may be employed. In this example, the rotor/stator ratio is a 6/7 ratio, although other ratios may be employed, such as 4/5, 5/6, and 7/8.

It will be understood by those skilled in the art that in an appropriate ratio, the motion induced in the rotor will be eccentric. The motion of the rotor 155 is transferred to a flow head 172. In this example, motion is induced in the flow head 172 by a universal adaptor 162 housed in an adaptor housing 160. The adaptor housing 160 is coupled to the stator 150 or the stator housing, as the case may be. The universal adaptor 162 is coupled, for instance by a threaded coupling, to the rotor 155. The universal adaptor 162 is also coupled by a drive shaft 164 to the flow head 172. The drive shaft 164 itself is fastened by retaining pins 166 to the adaptor 162 and flow head 172, or alternatively by ball joint. Other universal joint configurations may be used in place of the adaptor-drive shaft configuration illustrated in FIGS. 1 and 3. A cavity is thus effectively defined in the assembly 100 above the flow head 172, in communication with the passage 115.

The flow head 172 is housed in a valve housing 170 that is coupled to the adaptor housing 160, and rotates under influence of the rotor 155 within a radial bearing 174 retained in the valve housing 170. The lower external diameter of the flow head is sized to fit within the radial bearing 174 such that the radial bearing 174 constrains the motion of the flow head 172 to substantially rotational (non-eccentric) motion. As can be seen in FIG. 3, the interior diameter of the valve housing 170 has a step-wise reduction towards the motor end of the valve housing, with small shoulders on the interior face 173, 177 defining increases in interior diameter away from the motor end of the valve housing 170. The radial bearing 174 abuts or is positioned at the upper shoulder 173; this shoulder 173 defines an increase in interior diameter of the valve housing 170 to accommodate the radial bearing 174. The thickness of the radial bearing 174 can be selected so that the interior of the radial bearing 174 is substantially flush with the interior face of the valve housing 170 above the shoulder 173, so as to minimize obstruction in that area.

Ports provided in the flow head 172 and in a flow restrictor 180 positioned adjacent or proximate to the flow head 172 provide intermittent fluid communication between the motor section above the valve housing 170 and components of the drilling string positioned below the flow restrictor 180 via a further passage 195. As will be described in more detail below, as the flow head 172 rotates the ports in the flow head 172 intermittently cooperate with the ports in the flow restrictor 180 to permit fluid communication, and the flow restrictor 180 intermittently interferes with the ports in the flow head 172 to restrict or constrain fluid communication. The flow restrictor 180 is mounted within the valve housing 170 as well, and is stationary with respect to the valve housing 170 while the flow head 172 rotates under influence of the rotor 155.

In the example illustrated in the accompanying figures, an insert 176 is provided between the flow head 172 and the flow restrictor 180 to reduce wear on the flow head 172 or flow restrictor 180 due to the rotating motion of the flow head 172. The insert 176 may be manufactured from a hard metal such as a carbide. As will be described with additional reference to FIG. 6, the insert 176 includes ports that may be sized so as to not substantially interfere with fluid flow through the flow head 172. In the illustrated example, the insert 176 and the flow restrictor 180 present a substantially flush surface to permit substantially unimpeded travel by the flow head 172 over the insert 176 and flow restrictor 180. The flow restrictor 180 is sealingly engaged within the valve housing 170 using O-rings 182 or other sealing means to prevent passage of drilling fluid past the flow restrictor 180 except via the ports of the flow restrictor 180.

The valve housing 170 is coupled to another, lower sub 190, which may be a drill bit connector, or some other downstream component of the drill string. It will thus be appreciated from the foregoing description and FIGS. 1-3 that in operation, drilling fluid can flow down the passage 115 through the mandrel 110, inverter sub, motor section, adaptor section, and, subject to the relative positions of the flow head 172 and flow restrictor 180, through these components and down to the passage 195 leading to lower components of the drilling string.

Figure 5:
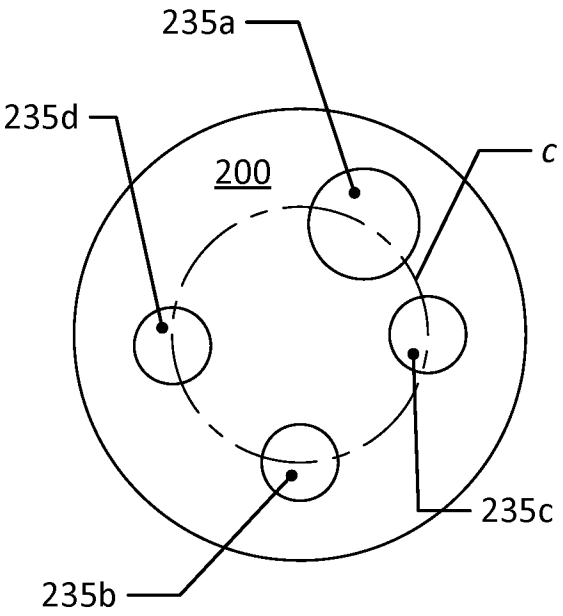
FIG. 5 is an axial cross-sectional view of a port end of the flow head of FIG. 4.
Figure 4:
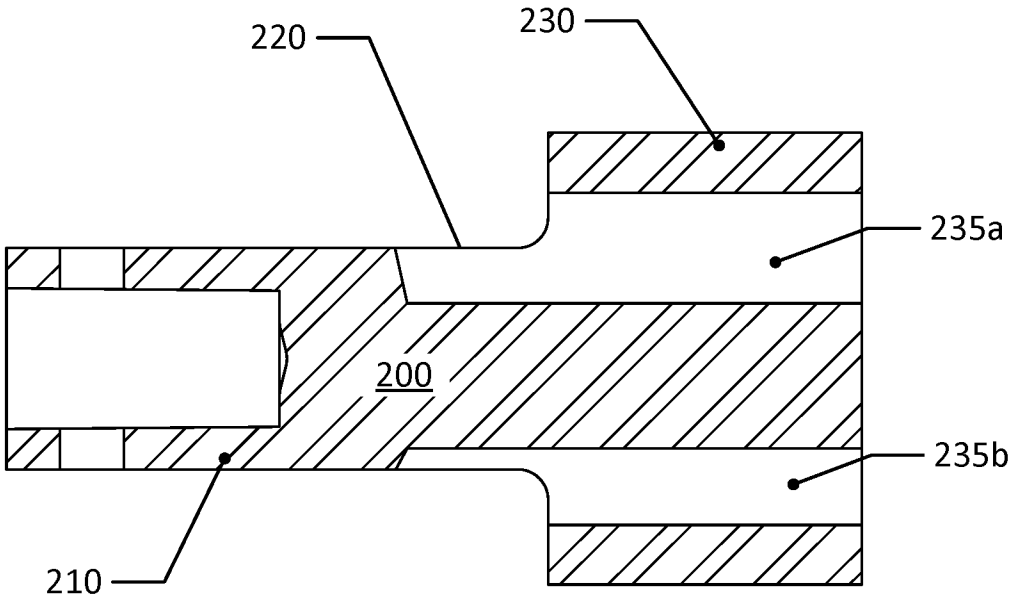
FIG. 4 is a lateral cross-sectional view of an example of a flow head for the downhole tool assembly of FIG. 1.

FIGS. 4 and 5 illustrate a particular example of the flow head 172 of FIGS. 1 and 3, here designated as flow head 200. It should be understood in FIGS. 4 and 5, as well as the remainder of the drawings, that these figures are not necessarily to scale, and that illustrated axial cross-sectional views may not be oriented in the same direction as the corresponding lateral cross-sectional views. The flow head 200 includes a mounting end 210, which is adapted to mate with a connector of the universal joint used to transfer motion from the rotor 155 (shown in FIGS. 1 and 3) to the flow head 200. An opposite end of the flow head 200, the body or port end 230 is provided with one or more ports 235*a*-235*d* extending through the body 230 to permit fluid passage therethrough. The body 230 of the flow head 200 is sized to fit within the drilling string, and specifically within the radial bearing 174 mentioned above; in the example of FIG. 4, the exterior width of the mounting end 210 is about 1⅝" and the exterior diameter of the body 230 is about 3 5/16". The difference in exterior dimension thus results in a shoulder region 220 being defined between the mounting end 210 and the body 230.

In the example of FIGS. 4 and 5, the body 230 is provided with four ports, although more or fewer ports may be provided. As can be seen in FIG. 5, the ports are generally circular or at least shaped with a substantially continuous wall so as to reduce accumulation of drilling fluid or debris, and thus facilitate unobstructed passage of drilling fluid. Other port shapes may also be used, however. The ports in this example are of varying diameter and are irregularly spaced. FIG. 5 illustrates that one port 235*a* is substantially larger in diameter than the remaining ports 235*b*-235*d*. In one implementation, the diameter of the larger port 235*a* is 13/16" while the others are 9/16". There may be, however, variation in dimension of the other ports. In the example of FIG. 5, all ports 235*a*-235*d* are generally arranged so that their centers are substantially equally spaced from the center of rotation of the flow head 200 (at a radius of about 15/16" of the body 230), as indicated by the guideline c which traces the approximate path of the centres of the ports 235*a*-235*d*; however, precision in this spacing is not required in this embodiment, and the ports are not necessarily regularly arranged around the center of rotation. The angle between the center of the largest port 235*a* and the center of the adjacent port 235*c* is about 60°; between the center of port 235*c* and the center of adjacent port 235*b* is about 90°; and between the center of port 235*b* and the center of adjacent port 235*d* is about 85°. As will be seen below, the irregular spacing and varying size of the ports 235*a*-235*d* each assist in creating a polyrhythmic and/or intermittent pressure variation in drilling fluid flowing through the downhole tool assembly 100 as a whole.

Figure 7:
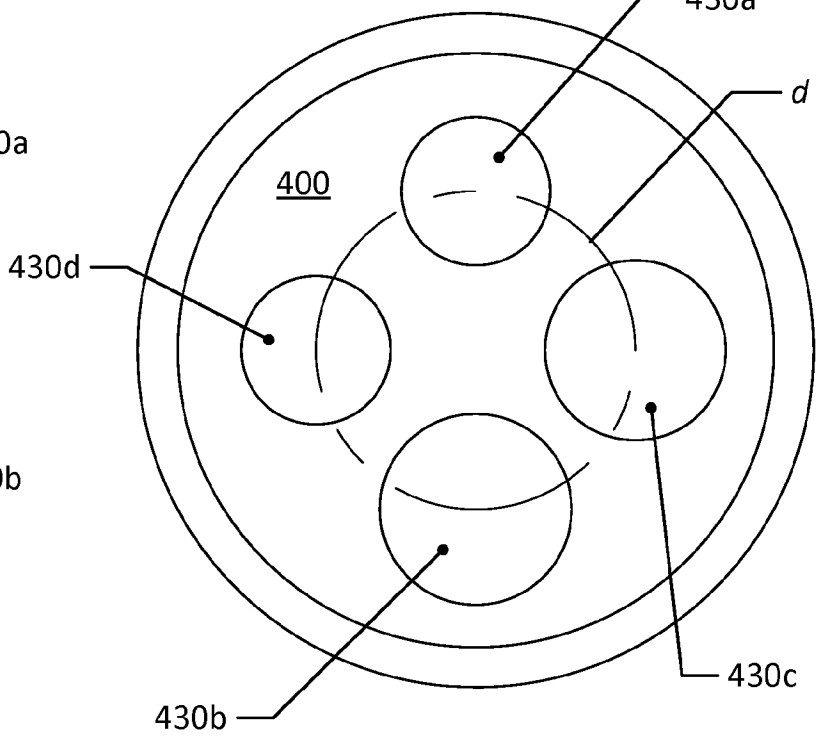
FIG. 7 is an axial cross-sectional view of the flow restrictor of FIG. 6.
Figure 6:
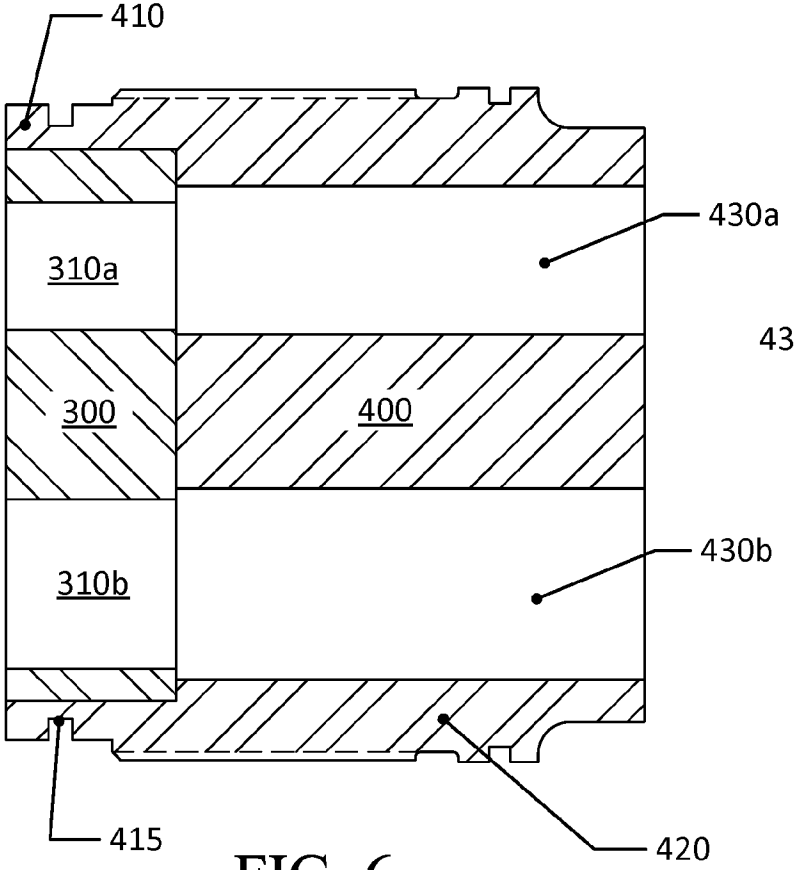
FIG. 6 is a lateral cross-sectional view of an example of a bearing insert and flow restrictor for the downhole tool assembly of FIG. 1.

As can be seen from FIG. 3, the flow restrictor 180 is sized to fit within the drilling string, and specifically within the valve housing 170 below the radial bearing 174. As mentioned above, an insert 176 may be disposed between the flow head 172 and the flow restrictor 180. FIGS. 6 and 7 provide further detail of the flow restrictor, here referred to as flow restrictor 400 and insert 300. The flow restrictor 400 here includes a body 420 that includes one or more ports 430*a*-430*d* extending therethrough, and a lip 410. The exterior dimensions of the body 420 and the lip 410 are generally sized to fit within the valve housing 170. As mentioned above, the flow restrictor 400 may be sealingly engaged with a seal 182 (shown in FIGS. 1 and 3) against the interior of the valve housing to reduce or prevent drilling fluid flow around the flow restrictor 400 other than through the ports 430*a*-430*d*. Recess 415 on the exterior surface of the lip 410 is provided for retaining a sealing ring. The flow restrictor 400 thus remains substantially stationary in the drilling string while the flow head 200 rotates.

The lip 410 of the flow restrictor 400 generally extends from the body 420 and defines a retaining area for the insert 300, also shown in FIG. 6. The insert 300 here is substantially cylindrical and is sized so that its upper surface (i.e., the surface contacting the flow head 200) is substantially flush with the upper edge of the lip 410. When in place in the valve housing 170, the upper edge and upper surface of the lip 410 and the insert 300, respectively, contacts the lower surface of the body 230 of the flow head 200. In this example, the interior diameter of the flow restrictor lip 410 is about 3.25" with a depth of 1", and the insert 300 is about 1" in height, and is sized to fit within the interior diameter of the lip 410. The insert 300 is provided with one or more ports corresponding to the ports of the flow restrictor 400 (in FIG. 6, only two ports of the insert, 310*a* and 310*b*, are visible).

The number, position, and dimensions of the ports 430*a*-430*d* provided in the flow restrictor 400 may be selected in order to obtain the desired polyrhythmic effect in drilling fluid pressure during operation. Turning to FIG. 7, in this particular example four substantially circular ports 430*a*-430*d* of varying size are positioned with their centers more or less equidistant from the center of the body 420 (at a radius of about 15/16" of the body 420), as can be seen with reference to guideline d, and are substantially evenly distributed around the center of the body 420, with the centers of the ports 430*a*-430*d* separated by 90°. In this example, the diameters of the ports 430*a*-430*d* range between ⅞" (for ports 430*a*, 430*d*) and 1⅛" (for port 430*b*). In the example illustrated in FIGS. 4-7, then, the ports 430*a*-430*d* of the flow restrictor 400 are sized so that when the center (i.e., axis) of one of these ports is substantially aligned with the center of a port 235*a*-235*d* of the flow head 200, fluid passage from the substantially aligned port of the flow head 200 is not obstructed by that port of the flow restrictor 400. With reference to FIG. 3, which best illustrates the relative dimensions of the ports in the flow head, insert, and flow restrictor in this particular example, it will be noted that the size of the ports in the insert may be selected as not to obstruct the ports of the flow head when the centers of the respective ports of these components are substantially aligned. However, the insert 300 may still contribute to interference blocking drilling fluid flow from the flow head 200 as the flow head 200 rotates.

Figure 8A:
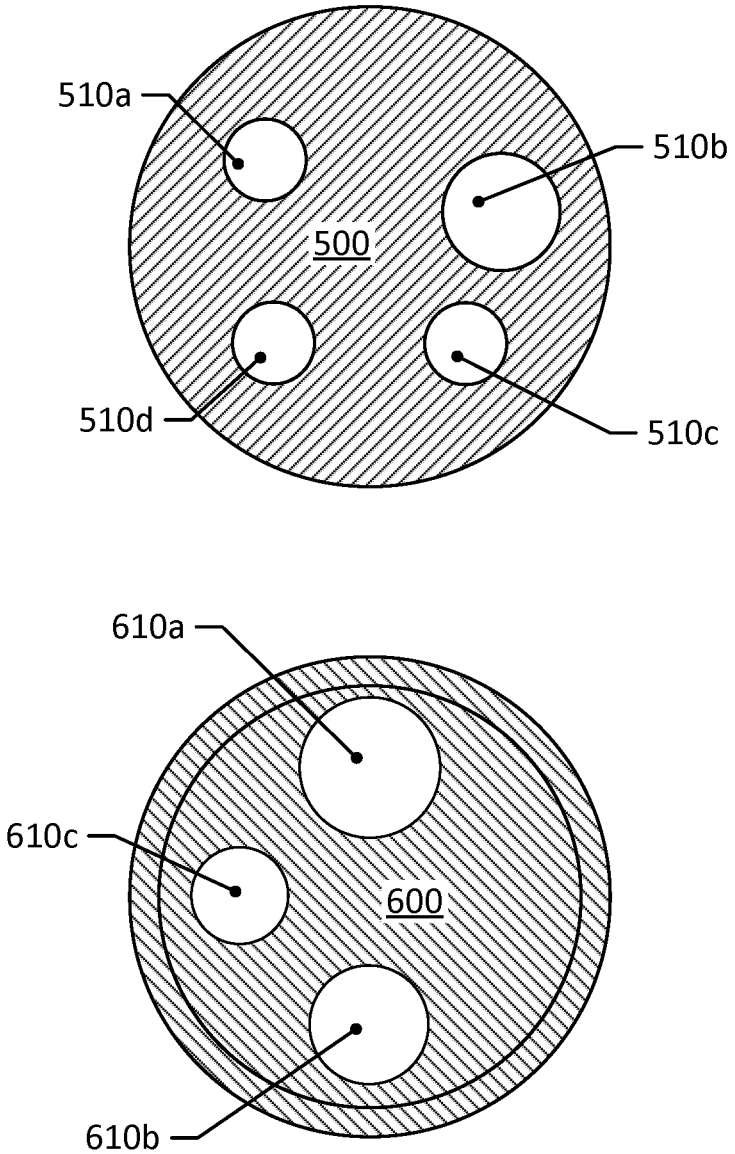
FIG. 8A illustrates axial cross-sectional views of another example of the flow head and flow restrictor.

It will be appreciated by those skilled in the art from a review of the axial cross-sections of the flow head 200 and the flow restrictor 400 that depending on the relative rotation of the flow head 200 with respect to the flow restrictor 400 at a given time in a cycle, some or all of a given port 235*a*, 235*b*, 235*c*, or 235*d* may be blocked, while others are completely unobstructed or only partially obstructed by the insert 300 and/or flow restrictor 400. It has been found that an arrangement of the ports of the flow head 200, insert 300, and/or flow restrictor 400 such that flow from all ports of the flow head 200 is obstructed during at least one point in a cycle (i.e., one full rotation of the flow head 200) provides an effect that improves the performance of the drilling tool. FIG. 8A illustrates axial cross-sections of a further example of a flow head 500 and a flow restrictor 600 in which the sizes (e.g., cross-sectional areas) and positions of the ports in each component are selected so as to provide blockage of the flow head ports once per cycle. The flow head 500 of FIG. 8A is provided with four ports 510*a*-510*d* substantially sized and positioned in the flow head 500 as described with reference to FIGS. 4 and 5. The flow restrictor 600, on the other hand, is provided with three ports 610*a*-610*c* rather than the four in the example flow restrictor 400 of FIGS. 6 and 7. In this example, the largest port 610*a* is larger in dimension (for example, corresponding to the larger port 430*b* in FIG. 7), and the other two 610*b* and 610*c* are smaller (for example, corresponding to the smaller ports 430*a* and 430*d*). The centers of the two ports 610*a* and 610*b* are positioned on a diameter of the flow restrictor 600 (not indicated in FIG. 8A), while the remaining port 610*c* is positioned 90° from either of these ports. The example flow restrictor 600 is thus effectively a variant of the flow restrictor 400, with port 430*c* either blocked off or not drilled at all.

Figure 8B:
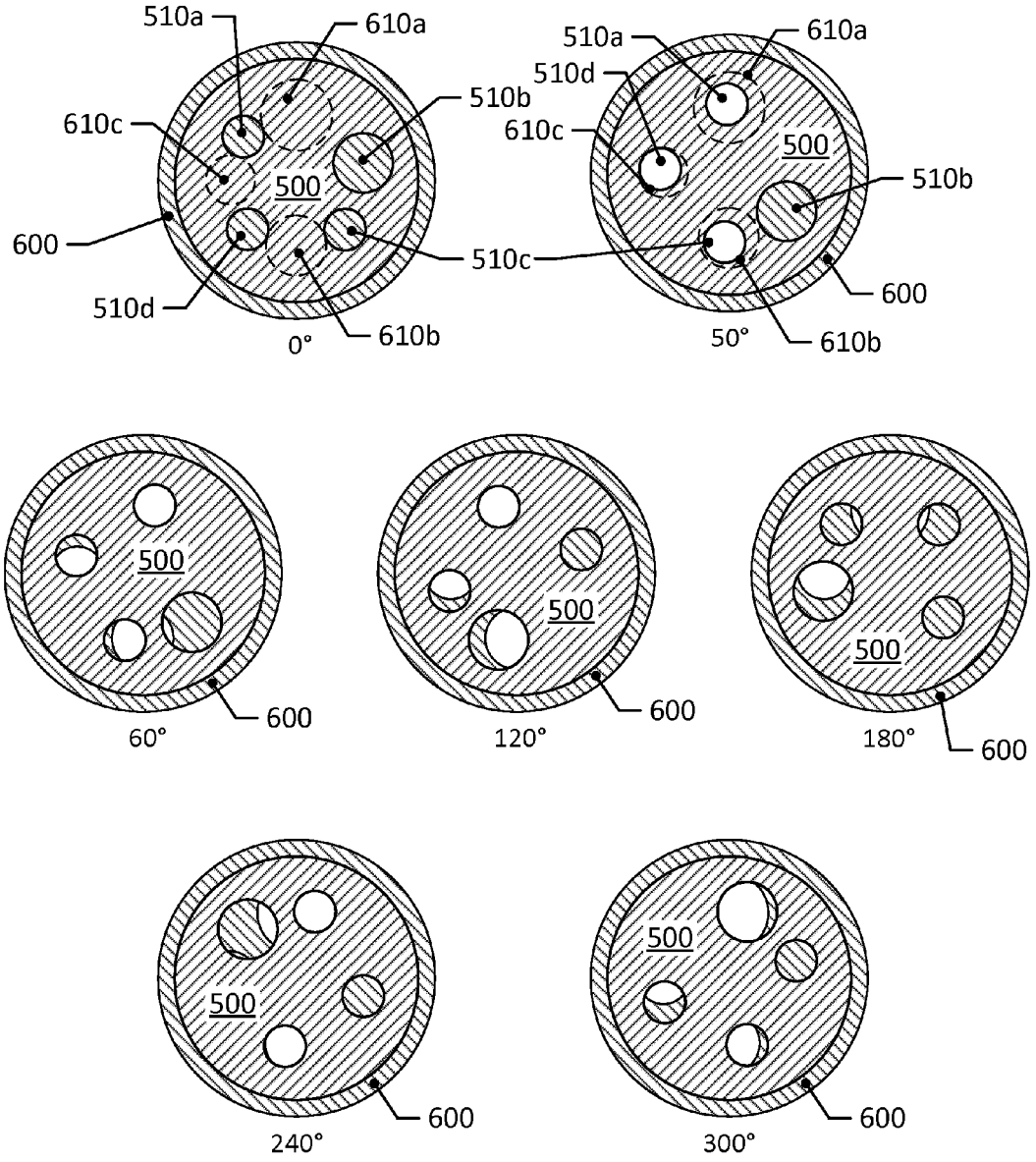
FIG. 8B provides axial cross-sectional views illustrating interference of the flow head and flow restrictor of FIG. 8A.
Figure 10:
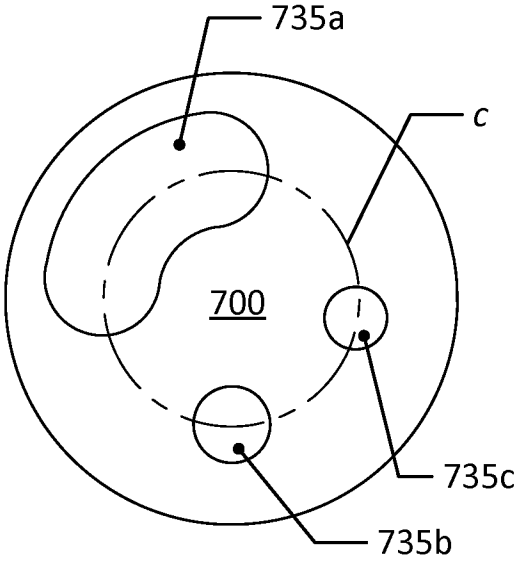
FIG. 10 is an axial cross-sectional view of a port end of the flow head of FIG. 9.

Turning to FIG. 8B, the effect of interference of the flow head 500 and the flow restrictor 600 can be seen at different rotational positions of the flow head 500 in a single cycle. In a first position, arbitrarily labeled 0°, all ports 510*a*-510*d* of the flow head 500 are effectively blocked. This position and the 50° position of FIG. 8B show the position of ports 610*a*-610*c* in phantom for reference. In a second position, at about 50° in this example, three out of four ports of the flow head 500 are unrestricted, with the largest port 510*b* remaining blocked by the flow restrictor 600. In this particular implementation, this position represents the greatest amount of flow permitted from the flow head 500 through the flow restrictor 600. It can be seen that for those three ports 510*a*, 510*c*, and 510*d* that are not blocked, their centers are not necessarily aligned with the centers of their corresponding ports 610*a*, 610*b*, and 610*c*. FIG. 8B also illustrates the interference or non-interference between the flow restrictor 600 and the flow head 500 in other positions of the cycle (60°, 120°, 180°, 240°, and 300°). Depending on the relative sizes of the ports 510*a*-510*d* and 610*a*-610*c*, it can be seen that the other positions of the flow head 500 during the cycle can result in fluid throughput ranging between or near-zero (the fully blocked position at) 0° and the maximum (in this example, at 50°).

Those skilled in the art will readily appreciated from the foregoing description the effect on fluid flow in during operation. Referring to FIGS. 1-3 again, drilling fluid flows down the passage 115 through the mandrel 110 and the spline housing 120 (if these components are included in the drilling string), and through the inverter sub housing 130 containing an assembly 135, and from these components to a motor section comprising a rotor-stator assembly 155, 150 such as that described above. The drilling fluid induces motion of the rotor 155 in accordance with the geometry of the rotor 155 and the stator 150; this motion in turn induces motion of the drive shaft 164. The drive shaft 164 in turn induces corresponding motion in the flow head 172, and in view of the drive shaft connection and the constraint on the motion of the flow head 172, the flow head's motion is limited to rotational movement (i.e., rotational movement around a central axis of the flow head body).

As the flow head 172 rotates against the (optional) carbide insert 176 and/or flow restrictor 180, the ports of the flow head 172 move into and out of alignment with the ports of the flow restrictor 180. Alignment is not necessarily restricted to alignment of the axes of flow head and flow restrictor ports; alignment can include only partial alignment, where only part of a given port of the flow head 172 is blocked by a solid region of the flow restrictor 180, and the remainder of that flow head port coincides with part of a port of the flow restrictor (refer to FIG. 8B for examples of alignment). When the positions, sizes, and profiles (i.e., cross-sectional shapes) of the ports in the flow head 172 and restrictor 180 are appropriately selected, during some interval of a given cycle of rotation, no port of the flow head 172 is aligned with a port of the flow restrictor 180, with the effect that flow of drilling fluid through the flow restrictor 180 is prevented. The result is a build-up of fluid pressure in the cavity and passage 115 above the flow head 172, which in turn operates on the assembly 135, which stores energy in response to the increased pressure. The effect of increased pressure causes the springs or other assembly 135 to extend the mandrel 110 in the drilling string. Of course, if another arrangement of flow head and/or flow restrictor ports was used instead, the volume pattern of fluid flow may be polyrhythmic or otherwise complex, but may not include an interval during which fluid flow is zero or approaches zero.

As the flow head 172 continues to rotate, some subset (at least one) of the ports of the flow head 172 begins entering into alignment with a subset of the ports of the flow restrictor, enabling drilling fluid to pass through the flow restrictor 180. The pressure in the cavity and passage 115 therefore begins to drop, and the assembly 135 returns the mandrel 110 to its original position. The variations in drilling fluid flow caused by rotation of the flow head 172 therefore produce corresponding axial movement in the drilling string.

An effect of the interaction between the flow head 172 and the restrictor 180 is that the available cross-sectional area of the passages through which drilling fluid can pass can vary, as a result of the irregular spacing and/or varying size of the ports. The irregular port spacing and/or varying port size may be present in the flow head 172, the restrictor 180, or both. Consequently the rate of drilling fluid flow and the fluid pressure within the drilling string can, in dependence on the spacing and/or sizes of the ports, be arranged to follow a complex rhythmic or polyrhythmic pattern. The polyrhythmic (although cyclic) fluid flow pattern gives rise to a correspondingly polyrhythmic pattern of drilling fluid pressure spikes or peaks of different magnitudes while drilling. The varying fluid flow and pressure effect can assist in varying the tension along the drilling string and preventing the drilling string from sticking during downhole use. During horizontal drilling, for instance, the effect can help displace solids within the wellbore, and prevent sediment from settling. This can improve the overall effect and efficiency of steerable or directional drilling.

In addition, the effect is enhanced in select examples described herein due to the combination of the polyrhythmic pattern and the interval of maximum fluid pressure induced by complete or near-complete interference of the flow head ports by the flow restrictor 180. Furthermore, referring to FIG. 8B, it can be seen that in this particular implementation, the time between the highest-pressure interval and the lowest-pressure interval in the flow head cycle is relatively short compared to the entire cycle period (since the time between the interval where the flow is at its minimum, at 0°, and the flow is at its maximum rate at 50°, is less than one-sixth of the entire period of flow head rotation). It will also be appreciated by those skilled in the art that over one revolution of the flow head, not only will the time interval between adjacent fluid pressure peaks (caused by restricted drilling fluid flow) vary, but the magnitudes of the fluid pressure peaks, including adjacent pressure peaks, will vary.

The duration between the points of minimum flow rate and maximum flow rate (i.e., the points at which the drilling fluid pressure is highest and lowest), the time intervals between adjacent fluid pressure peaks, and the magnitudes of the peaks, can be adjusted by the selection of an appropriate rotor/stator ratio and port configuration in the flow head and/or restrictor. Thus, within a cycle, some or all of the time intervals between adjacent fluid pressure peaks can be different, and some or all of the magnitudes of the pressure peaks can be different. In some implementations, the configuration of the assembly 100 can be chosen so that some of the time intervals between adjacent fluid pressure peaks and/or some of the magnitudes of the pressure peaks within a given cycle are constant (i.e., equal or substantially equal). The polyrhythmic pressure peak pattern resulting from the embodiments and suitable variations contemplated herein can reduce interference with or damage to other downhole equipment, such as MWD and survey equipment. With appropriate selection of the rotor/stator ratio and/or port configurations, as well as the ratio of the number of ports and/or port cross-sectional areas in the flow head to the number of ports and/or port cross-sectional areas in the flow restrictor, the frequency of the pressure spikes can be controlled and selected so as to further reduce interference with downhole equipment. These selections may be influenced by the characteristics of the drilling mud or other components used in the drilling operation. As explained above, the port configurations may be modified by changing the number, dimensions, and profiles of the ports; it may be noted, though, that it is most convenient to employ a circular profile (i.e., a cylindrical port), as this is most easily manufactured.

It will be understood that the insert 176 may be considered to be part of a flow restrictor component of the assembly 100, as the insert 176 is substantially stationary with the flow restrictor 180, and only modifies the function of the flow restrictor 180 to the extent that it limits flow through to the flow restrictor ports. The flow head 172 and flow restrictor 180 with optional insert 176 may be considered to form part of a valve in the drilling string.

Figure 9:
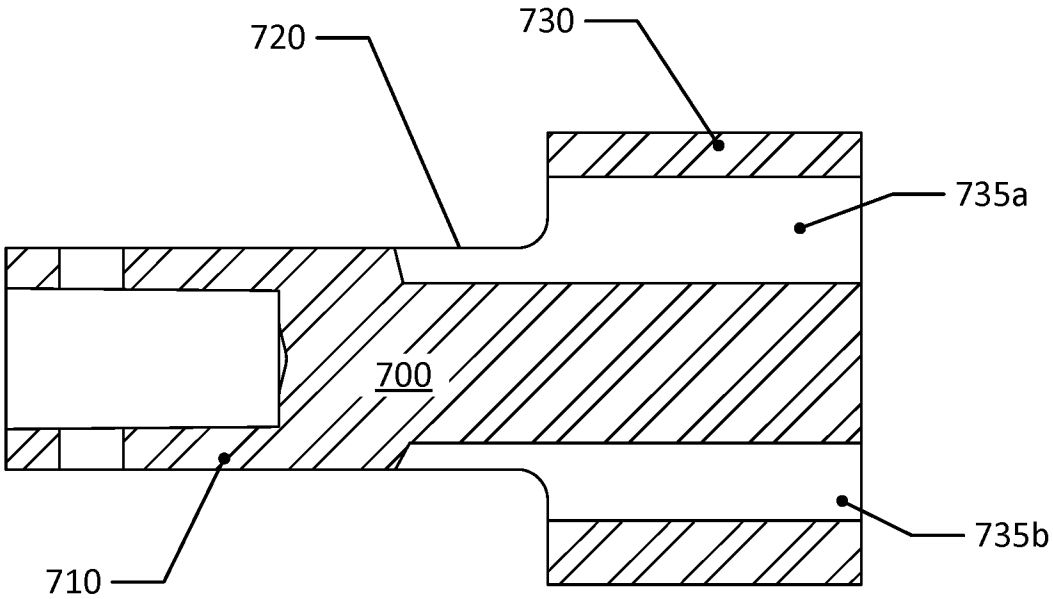
FIG. 9 is a lateral cross-sectional view of a further example of a flow head.

FIGS. 9 to 14 illustrate further examples of flow heads and their interaction with flow restrictors. Turning to FIG. 9, an example flow head 700 again includes a mounting end 710, adapted to mate with a universal joint as described above and a body or port end 730 having a number of ports 735*a*, 735*b*, and 735*c* (the latter shown in FIG. 10) that extend through the body 730 to permit fluid passage. A shoulder region 720 defines the transition from the mounting end 210 to the body 730. Dimensions of this example flow head 700 may be similar to those given above. While the walls of the ports 735*a*, 735*b*, 735*c* are generally shaped so as to be substantially continuous, it can be seen in FIG. 10 that the flow head 700 has an elongated port 735*a* with a substantially "kidney"-shaped cross-section, with its longitudinal center generally spaced from the center of the flow head 700 the same distance as the centers of the other ports 735*b*, 735*c*, as illustrated by guideline c.

Figure 11A:
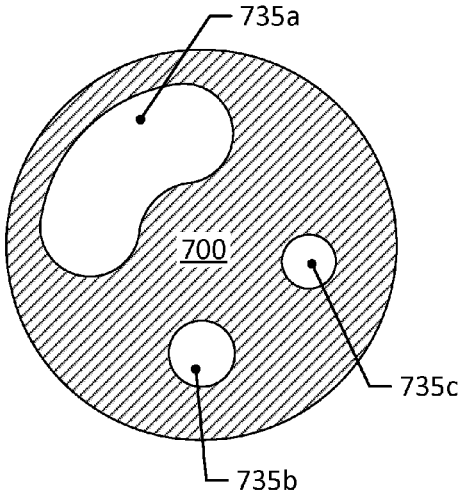
FIGS. 11A and 11B illustrate axial cross-sectional views of the flow head of FIG. 9 and a possible corresponding flow restrictor.
Figure 11B:
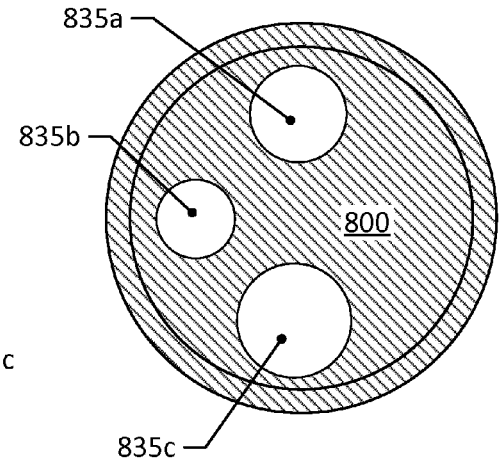
Figure 12A:
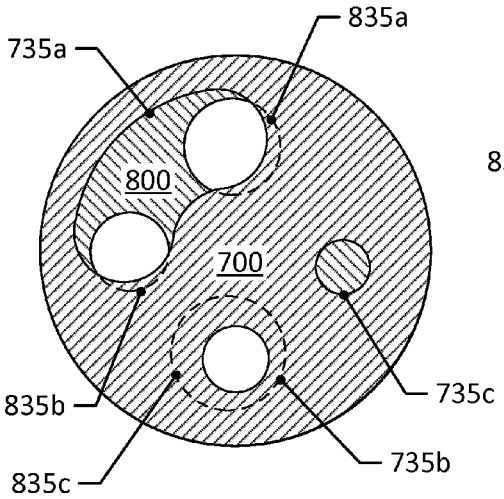
FIGS. 12A and 12B are axial cross-sectional views illustrating interference of the flow head and flow restrictor of FIGS. 11A and 11B.
Figure 12B:
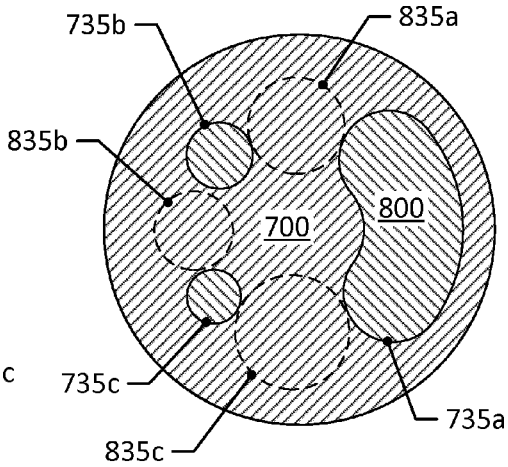

The elongated port 735*a* is positioned such that in use, it remains in alignment with a corresponding port in the flow restrictor 800 for longer than other ports 735*b*, 735*c* of the flow head 700. FIGS. 11A and 11B illustrate the cross-section of the flow head 700 of FIG. 10 and a cross-section of an example corresponding flow restrictor 800, respectively, both at an initial orientation. In this example, the flow restrictor 800 has three ports 835*a*, 835*b*, and 835*c*, of varying diameter. FIG. 12A illustrates the relative positions of the ports 735*a*, 735*b*, 735*b* and 835*a*, 835*b*, 835*c* during operation in this initial orientation. The elongated port 735*a* of the flow head 700 is substantially aligned with both ports 835*a* and 835*b* of the flow restrictor 800, and smaller port 735*b* of the flow head 700 is aligned with port 835*c* of the flow restrictor 800. The complete profile of the flow restrictor ports 835*a*, 835*b*, 835*c* is shown in phantom. The third port 735*c* of the flow head 700 is not aligned with any port of the flow restrictor 800. During rotation of the flow head 700, one or more ports of the flow restrictor 800 will therefore be open, or partially open, as a result of alignment with the elongated port 735*a* for longer duration than in the example of FIG. 8B. In the subsequent orientation shown in FIG. 12B, no ports 735*a*, 735*b*, 735*c* of the flow head 700 are aligned with any of the ports 835*a*, 835*b*, 835*c* of the flow restrictor 800. Thus, as the flow head 700 rotates through this orientation, fluid flow will taper off to zero or substantially zero.

It will be appreciated that the elongated port 735*a* in this example can reduce the amount of pressure build-up due to the extended period of alignment of the port 735*a* with ports of the flow restrictor 800. This type of interference between the ports of the flow head 700 and the restrictor 800 can also be achieved by other port shapes such as an ellipse or crescent-like shape, while still providing for at least one flow head orientation where all ports are blocked or substantially blocked. The precise shape of the elongated port 735*a* in this example should not be construed as limiting.

Figure 14:
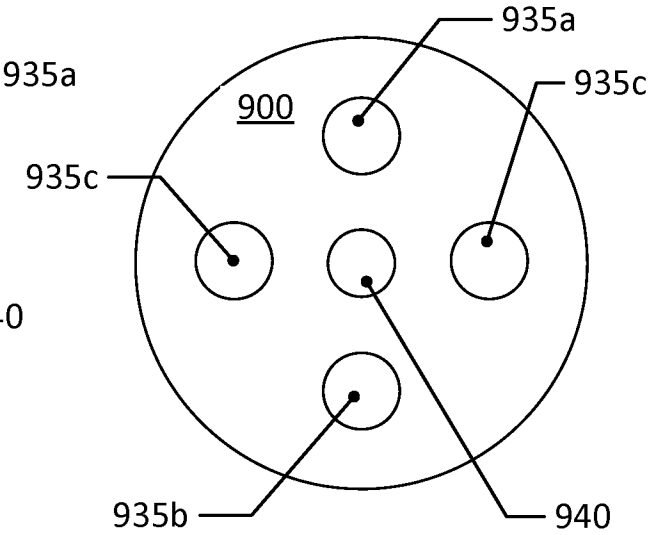
FIG. 14 is an axial cross-sectional view of another example of the flow head of FIG. 13.
Figure 13:
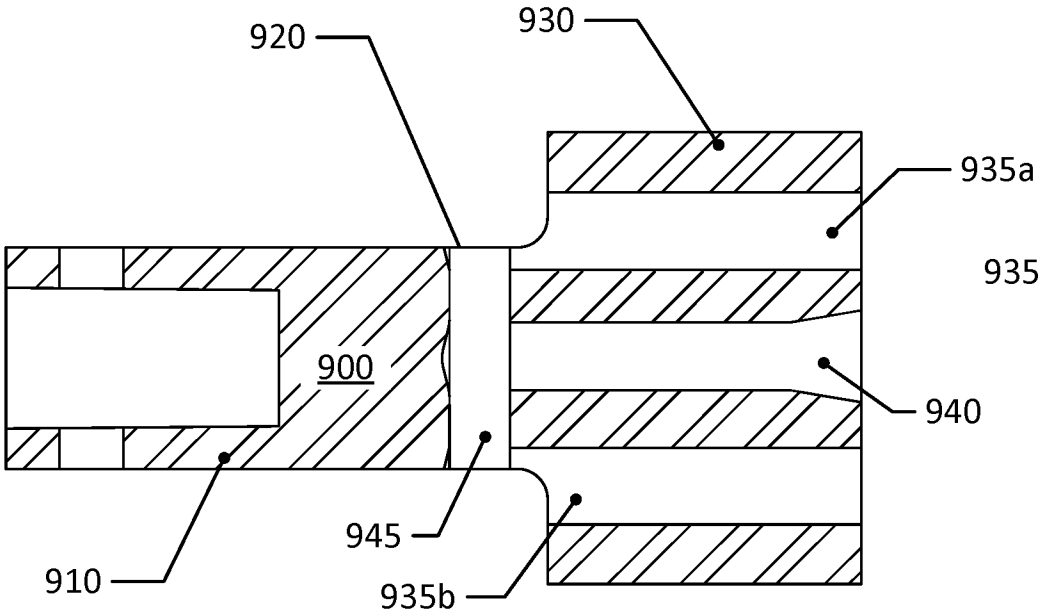
FIG. 13 is a lateral cross-sectional view of another example of a flow head.

FIGS. 13 and 14 illustrate a further example of a flow head 900, again with a mounting end 910 and body 930 meeting at a shoulder region 920, and multiple ports 935*a*-935*d* (935*a* and 935*b* are visible in FIG. 13). As in earlier examples, the multiple ports 935*a*-935*b* are distributed between the center and the periphery of the flow head 900, and they may be similarly or differently sized. The flow head 900 is also provided with a centrally-located port 940, which is fed by a laterally-extending channel 945 in the shoulder region 920. With this arrangement, some amount of drilling fluid flow can be maintained throughout operation of the downhole tool assembly, while still providing the polyrhythmic flow discussed above.

Various embodiments of the present invention having been thus described in detail by way of example, it will be apparent to those skilled in the art that variations and modifications may be made without departing from the invention. The invention includes all such variations and modifications as fall within the scope of the appended claims. For instance, the number, sizes, and profiles of the ports in the flow head and the flow restrictor described herein may be modified as appropriate to accomplish a desired effect, or to accommodate particular equipment or drilling fluid. Throughout the specification, terms such as "may" and "can" are used interchangeably and use of any particular term should not be construed as limiting the scope or requiring experimentation to implement the claimed subject matter or embodiments described herein.

The invention claimed is:

1. A downhole tool assembly, comprising:

a motor;

a flow head comprising a plurality of ports permitting fluid communication therethrough and arranged around a central axis of the flow head, the flow head being coupled to a rotor of the motor to be driven thereby in rotational motion around the central axis;

a flow restrictor in fluid communication with the flow head, the flow restrictor comprising a plurality of ports permitting fluid communication therethrough, the flow restrictor being stationary with respect to the rotational motion of the flow head, wherein rotation of the flow head with respect to the flow restrictor causes one or more of the plurality of ports of the flow head to enter into and out of alignment with one or more of the plurality of ports of the flow restrictor such that fluid pressure resulting from fluid flow through the ports of the flow head and the flow restrictor is constrained to a cyclic, polyrhythmic pattern.

2. The downhole tool assembly of claim 1, wherein the pattern comprises a plurality of fluid pressure peaks of varying amplitude within a single revolution of the flow head in the downhole tool assembly.

3. The downhole tool assembly of claim 1, wherein the pattern comprises a plurality of fluid pressure peaks with a plurality of time intervals of different durations between adjacent fluid pressure peaks within a single revolution of the flow head in the downhole tool assembly.

4. The downhole tool assembly of claim 1, wherein the pattern includes at least one interval where the fluid flow is substantially blocked by the flow restrictor.

5. The downhole tool assembly of claim 1, wherein the flow head comprises a plurality of ports having at least two different cross-sectional areas, and the plurality of ports of the flow restrictor comprise having at least two different cross-sectional areas.

6. The downhole tool assembly of claim 5, wherein the at least two different cross-sectional areas of the plurality of ports of the flow head are different than the at least two different cross-sectional areas of the plurality of ports of the flow restrictor.

7. The downhole tool assembly of claim 5, wherein at least one port of the plurality of ports of the flow head comprises an elongated port.

8. The downhole tool assembly of claim 5, wherein the flow head has a different number of ports than the flow restrictor.

9. The downhole tool assembly of claim 1, wherein the motor comprises a positive displacement motor having a stator with a different number of lobes than the rotor.

10. The downhole tool assembly of claim 9, further comprising a bearing constraining motion of the flow head to rotational motion around the central axis.

11. The downhole tool assembly of claim 1, further comprising an inverter sub in fluid communication with the motor, the motor being positioned between the inverter sub and the flow head, the inverter sub imparting an axial movement to a mandrel.

12. The downhole tool assembly of claim 1, wherein the flow restrictor comprises a wear insert between the flow head and the flow restrictor, the wear insert comprising ports permitting fluid communication between the flow head and ports of the flow restrictor.

13. A drilling string for use in downhole drilling comprising the downhole tool assembly of claim 1.

14. The downhole tool assembly of claim 1, wherein the flow head is coupled to the rotor by a universal joint.

15. The downhole tool assembly of claim 1, wherein the flow head and flow restrictor are positioned downstream of the motor.

16. A valve component for use in a downhole drilling string, the valve component comprising:

a flow head comprising a plurality of ports permitting fluid communication therethrough and arranged around a central axis of the flow head, the plurality of ports including ports of different sizes;

a flow restrictor comprising a plurality of ports permitting fluid communication therethrough, the plurality of ports including ports of different sizes;

the arrangement of the plurality of ports of the flow head being arranged such that rotation of the flow head around its central axis with respect to the flow restrictor causes one or more of the plurality of ports of the flow head to enter into and out of alignment with one or more of the plurality of ports of the flow restrictor, such that fluid pressure resulting from fluid flow through the ports of the flow head and the flow restrictor is constrained to a cyclic, polyrhythmic pattern.

17. The valve component of claim 16, wherein the pattern comprises a plurality of fluid pressure peaks of varying amplitude within a single revolution of the flow head in the valve component.

18. The valve component of claim 16, wherein the pattern comprises a plurality of fluid pressure peaks with a plurality of time intervals of different durations between adjacent fluid pressure peaks within a single revolution of the flow head in the valve component.

19. The valve component of claim 16, wherein the pattern includes at least one interval where the fluid flow is substantially blocked by the flow restrictor.

20. The valve component of claim 16, wherein the sizes of the ports of the flow restrictor are different from the sizes of the ports of the flow head.

21. The valve component of claim 16, wherein the flow head has a different number of ports than the flow restrictor.

22. The valve component of claim 16, wherein the plurality of ports of the flow restrictor are arranged around a central axis of the flow restrictor, and the plurality of ports around at least one of the flow restrictor and the flow head are irregularly spaced around the respective central axis.

23. The valve component of claim 16, wherein at least one port of the plurality of ports of the flow head comprises an elongated port.

24. The valve component of claim 16, wherein the flow head further comprises a mounting end for coupling to a drive shaft of a motor.

25. The valve component of claim 16, wherein the flow restrictor comprises a wear insert between the flow head and the flow restrictor, the wear insert comprising ports permitting fluid communication between the flow head and ports of the flow restrictor.

26. A method of varying drilling fluid pressure in a downhole drilling string, the method comprising:

varying flow of the drilling fluid in the drilling string above a drilling tool of the drilling string such that a pressure of the drilling fluid varies in a cyclic, polyrhythmic pattern, wherein the pattern is defined by interference between a flow head rotating in the drilling string relative to a flow restrictor positioned in the drilling string, each of the flow head and the flow restrictor comprising a plurality of ports, the plurality of ports in the flow head comprising different sizes and the plurality of ports in the flow restrictor comprising different sizes, wherein the flow of the drilling fluid is determined by alignment of any of the plurality of ports of the flow head with any of the plurality of ports of the flow restrictor.

27. The method of claim 26, the pattern including at least one interval in its cycle where the flow of the drilling fluid is substantially stopped.

28. The method of claim 26, wherein the pattern comprises a plurality of fluid pressure peaks of varying amplitude.

29. The method of claim 26, wherein the pattern comprises a plurality of fluid pressure peaks with a plurality of time intervals of different durations between adjacent fluid pressure peaks.

30. The method of claim 26, wherein the flow head comprises a number of ports of at least two different sizes and the flow restrictor comprises a different number of ports of at least two different sizes, the at least two different sizes of the flow restrictor ports being different than the sizes of the flow head ports.

31. The method of claim 30, further comprising rotating the flow head using a positive displacement motor, the flow head being constrained to rotational motion around a central axis of the flow head within the drilling string.

32. The method of claim 31, wherein the flow head and flow restrictor are positioned in the drilling string below the motor.

33. The method of claim 26, wherein the flow of the drilling fluid is substantially stopped when all of the plurality of ports of the flow head are blocked by the flow restrictor.

34. The method of claim 26, wherein a variation in flow of the drilling fluid induces a corresponding variation in pressure in the drilling string by means of an inverter sub comprised in the drilling string.

35. The method of claim 31, wherein the flow head is coupled to a rotor of the motor by a universal joint.

36. A method of varying drilling fluid pressure in a downhole drilling string, the method comprising:

pumping the drilling fluid into the downhole drilling string, the string comprising a motor, a flow head, a flow restrictor, and a drilling tool;

the flow head comprising a plurality of ports permitting fluid communication therethrough and arranged around a central axis of the flow head, the flow head being coupled to a rotor of the motor to be driven thereby in rotational motion around the central axis; and the flow restrictor comprising a plurality of ports permitting fluid communication therethrough, the flow restrictor being stationary with respect to the rotational motion of the flow head and in fluid communication with the flow head, the flow head and the flow restrictor being positioned downstream of the motor and above the drilling tool, whereby rotation of the flow head driven by the motor with respect to the flow restrictor causes one or more of the plurality of ports of the flow head to enter into and out of alignment with one or more of the plurality of ports of the flow restrictor such that fluid pressure resulting from fluid flow through the ports of the flow head and the flow restrictor is constrained to a cyclic, polyrhythmic pattern, a flow of the drilling fluid in the drilling string above the drilling tool being varied such that a pressure of the drilling fluid varies in a cyclic, polyrhythmic pattern.

37. The method of claim 36 wherein the flow head is coupled to the rotor by a universal joint.

38. The method of claim 36 wherein the flow head comprises a plurality of ports having at least two different cross-sectional areas, and the plurality of ports of the flow restrictor comprise at least two different cross-sectional areas.

39. The method of claim 38, wherein the at least two different cross-sectional areas of the plurality of ports of the flow head are different than the at least two different cross-sectional areas of the plurality of ports of the flow restrictor.

* * * * *